US010351324B2

(12) United States Patent
Yokoyama et al.

(10) Patent No.: US 10,351,324 B2
(45) Date of Patent: Jul. 16, 2019

(54) PACKAGE

(71) Applicant: SUNTORY HOLDINGS LIMITED, Osaka (JP)

(72) Inventors: Hiroki Yokoyama, Tokyo (JP); Masayuki Kitamasu, Tokyo (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 428 days.

(21) Appl. No.: 14/902,070

(22) PCT Filed: Jun. 27, 2014

(86) PCT No.: PCT/JP2014/067266
§ 371 (c)(1),
(2) Date: Dec. 30, 2015

(87) PCT Pub. No.: WO2015/002108
PCT Pub. Date: Jan. 8, 2015

(65) Prior Publication Data

US 2016/0368690 A1 Dec. 22, 2016

(30) Foreign Application Priority Data

Jul. 1, 2013 (JP) ..... 2013-138245

(51) Int. Cl.
*B65D 75/58* (2006.01)
*B65D 77/00* (2006.01)
(Continued)

(52) U.S. Cl.
CPC ..... *B65D 77/36* (2013.01); *B65D 75/5838* (2013.01); *B65D 77/003* (2013.01); *B65D 77/32* (2013.01)

(58) Field of Classification Search
CPC .. B65D 75/5838; B65D 77/003; B65D 77/32; B65D 77/36
(Continued)

(56) References Cited

U.S. PATENT DOCUMENTS 4,077,516 A 3/1978 Duerr
4,192,420 A * 3/1980 Worrell, Sr. ..... B65D 81/22 206/205
(Continued)

FOREIGN PATENT DOCUMENTS

CN 102272010 12/2011
DE 19822328 11/1999
(Continued)

OTHER PUBLICATIONS

Search Report in PCT/JP2014/067266, dated Oct. 7, 2014.
(Continued)

*Primary Examiner* — Anthony D Stashick
*Assistant Examiner* — Kaushikkumar A Desai
(74) *Attorney, Agent, or Firm* — Greenblum & Bernstein P.L.C.

(57) ABSTRACT

An improvement is made in a package including a protective film enclosing an article and a tack label coupled to an outer surface of the protective film such that a step of forming a slit in the protective film can be omitted and the need to form a dent at a specific area in the article is eliminated. A protective film includes an overlapping portion in which a first edge portion directly opposing the article and a second edge portion opposing the article via the first edge portion are overlapped with each other, and in a coupling surface between a tack label coupled so as to cover the overlapping portion and a protective film, a non-uniform coupling force distribution is provided in which a second region continuously connected to the second edge portion has a higher
(Continued)

coupling force than a first region continuously connected to the first edge portion.

4 Claims, 6 Drawing Sheets

(51) Int. Cl.
*B65D 77/32* (2006.01)
*B65D 77/36* (2006.01)

(58) Field of Classification Search
USPC ..... 220/226, 266
See application file for complete search history.

(56) References Cited

U.S. PATENT DOCUMENTS

| | | | | |
|---|---|---|---|---|
| 4,679,699 | A | 7/1987 | Malsbury et al. | |
| 8,608,895 | B2 * | 12/2013 | Sato | B29C 65/18 156/292 |
| 2007/0164094 | A1 * | 7/2007 | Takahashi | B65D 77/2044 229/123.1 |
| 2008/0240627 | A1 * | 10/2008 | Cole | B65D 75/5838 383/204 |
| 2009/0154845 | A1 | 6/2009 | Kerr et al. | |
| 2010/0172604 | A1 * | 7/2010 | Andersson | B65D 75/366 383/211 |
| 2010/0278454 | A1 * | 11/2010 | Huffer | B65D 75/5838 383/5 |
| 2015/0245733 | A1 * | 9/2015 | Castellani | A47J 31/0673 426/112 |
| 2016/0176601 | A1 * | 6/2016 | Boekeloo | B65D 75/12 206/457 |

FOREIGN PATENT DOCUMENTS

| | | |
|---|---|---|
| GB | 2156767 | 10/1985 |
| JP | 48156/1986 | 3/1986 |
| JP | 129759/1986 | 8/1986 |
| JP | 1148/1992 | 1/1992 |
| JP | 4-327141 | 11/1992 |
| JP | 2006-137470 | 6/2006 |
| JP | 2006-248577 | 9/2006 |
| JP | 2006-256665 | 11/2006 |
| JP | 2006-301236 | 11/2006 |
| JP | 2009-298464 | 12/2009 |

OTHER PUBLICATIONS

International Preliminary Report on Patentability for PCT/JP2014/067266, dated Jan. 5, 2016.
English Machine Translation of JP2006-256665.
English Machine Translation of JP2006-301236.
English Machine Translation of JPH04-1148.
English Machine Translation of JP2006-137470.
English Machine Translation of JP2006-248577.
English Machine Translation of JPH04-327141.
English Machine Translation of JPS61-129759.
English Machine Translation of JP2009-298464.
Office Action issued in China Counterpart Patent Appl. No. 201480037787.7, dated Dec. 29, 2016.
Search Report issued in European Patent Office (EPO) Patent Application No. 14819879.9, dated Jan. 3, 2017.

* cited by examiner

PACKAGE

TECHNICAL FIELD

The present invention relates to a package including a protective film enclosing an article and a tack label coupled to an outer surface of the protective film.

BACKGROUND ART

Patent Document 1 described below is a piece of prior art document information related to this type of package. In the package disclosed in Patent Document 1, a V-shaped slit is formed in advance in a portion of a protective film, and a tack label is bonded so as to cover the slit. When a user pinches the tack label and peels the tack label from the package, the protective film is ruptured along the width of the V shape, with only an inner portion of the V shape being bonded to the tack label due to the adhesive force of the tack label, and thus the protective film can be easily removed.

PRIOR ART DOCUMENT

Patent Document

Patent Document 1: JP 2006-256665 A (paragraphs [0003] and [0015], and FIGS. 1, 3 and 6)

DISCLOSURE OF THE INVENTION

Problem to be Solved by the Invention

However, the technique disclosed in Patent Document 1 requires a complex apparatus and step for forming the slit having a special shape at a specific position in the protective film.

Also, the technique disclosed in Patent Document 1 requires the need to form a dent or the like in a portion of the article so as to not cause damage to the article when forming the slit in the protective film.

In view of the problems encountered with the conventional technique described above as an example, it is an object of the present invention to provide a package with which it is possible to omit a complex apparatus and step for forming a slit in the protective film and eliminate the need to form a dent at a specific area in the article.

Means for Solving Problem

A characteristic configuration of a package according to the present invention lies in a package including a protective film enclosing an article and a tack label coupled to an outer surface of the protective film, wherein the protective film includes an overlapping portion in which a first edge portion directly opposing the article and a second edge portion opposing the article via the first edge portion are overlapped with each other, the tack label is coupled so as to cover the overlapping portion, and in a coupling surface between the protective film and the tack label, a non-uniform coupling force distribution is provided in which a second region that is continuously connected to the second edge portion has a higher coupling force than a first region that is continuously connected to the first edge portion.

In the package having the above-described characteristic configuration, when the tack label is peeled from the package, by the action of the non-uniform coupling force distribution, the second edge portion (or in other words, the area opposing the article via the first edge portion) continuously connected to the second region is first peeled from the first edge portion (or in other words, the area directly opposing the article) continuously connected to the first region, and thus smooth removal of the protective film without causing a rupture in the protective film takes place. As a result, by simply peeling the tack label from the package without forming a slit in the protective film in advance, the protective film can be smoothly removed and the need to form a dent at a specific area in the article is also eliminated.

Another characteristic configuration according to the present invention lies in that an extension portion extending radially outwardly from the article is provided on the first region side of the tack label such that the tack label is longer on the first region than on the second resion side.

With this configuration, a user who attempts to unwrap the package so as to take out the article therefrom is naturally prompted to perform an operation of pinching the extension portion of the tack label and removing the tack label at the time of removing the tack label from the package, and thus among others, a tip end side of the second edge portion coupled to the tack label is removed from the first edge portion, as a result of which the second edge portion is more smoothly peeled from the first edge portion.

Another characteristic configuration according to the present invention lies in that the second edge portion is coupled to the first edge portion by electrostatic sealing.

With this configuration, as compared to a configuration in which the second edge portion is coupled to the first edge portion by a heat seal or an adhesive, a flat and thin overlapping portion with less irregularities can be obtained, and thus the upper surface of the tack label coupled to the protective film has a flat finish, and a package having an excellent outer appearance can be obtained.

Another characteristic configuration according to the present invention lies in that a perforated line extending along the first edge portion is provided in the first region of the protective film.

With this configuration, even if the second edge portion is not peeled from the first edge portion along with the removal of the tack label due to the binding force between the first edge portion and the second edge portion at the overlapping portion being too strong, the protective film is cut at the position of the perforated line, and thus the overlapping portion of the protective film coupled to the tack label is separated together with the second region from the first region, as a result of which smooth removal of the protective film takes place.

BEST MODE FOR CARRYING OUT THE INVENTION

Hereinafter, embodiments of the present invention will be described with reference to the drawings.

Figure 1:
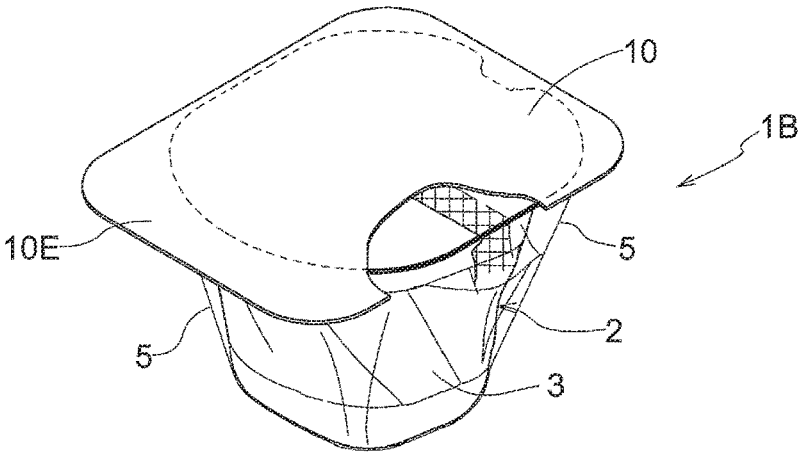
FIG. 1 is a perspective view showing a package according to the present invention.

FIG. 1 shows an external view of a package 1B according to an embodiment of the present invention. The package 1B is a package obtained by adhesively attaching (an example of coupling) a tack label 10 to an upper surface of an intermediate package 1A (see FIG. 3) in which the entirety of a portion container 2 (an example of the article) is wrapped with a heat-shrinkable resin film 5 (an example of the protective film).

As the heat-shrinkable resin film 5, a biaxially drawn polypropylene film or the like having a thickness of, for example, about 10 μm can be used, and as the tack label 10, various types of paper can be used.

Configuration of Portion Container

Figure 2:
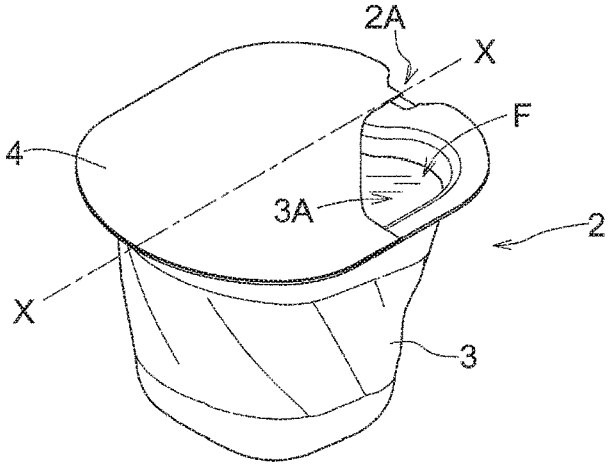
FIG. 2 is a perspective view showing a portion container, which is an example of an article.

As shown in FIG. 2, the portion container 2 in an unwrapped state includes a container body 3 and a thin-sheet like lid member 4 that seals an opening 3A of the container body 3. A substance F such as a liquid is hermetically contained in the portion container 2. The lid member 4 is heat sealed to a flange portion of the opening 3A with a seal bar (not shown).

An opening control mechanism (not shown) is provided between a predetermined area of the opening 3A of the portion container 2 and the lid member 4. The opening control mechanism is configured to, if an external force exceeding a certain value is applied to a bottom portion or the like of the container body 3, open the lid member 4 by increased internal pressure. The position of a spout 2A for discharging the substance F, which is formed as a result of the lid member 4 being opened, is shown.

For the sake of convenience, the area around the spout 2A will be referred to as the front end of the package 1 and the portion container 2, the area that is radially opposed to the spout 2A along a surface of the lid member 4 will be referred to as the rear end, and the direction of an axis X extending along the lid member 4 so as to connect the front end and the rear end will be referred to as the lengthwise direction.

Wrapped Configuration Using Heat-Shrinkable Resin Film

Figure 3:
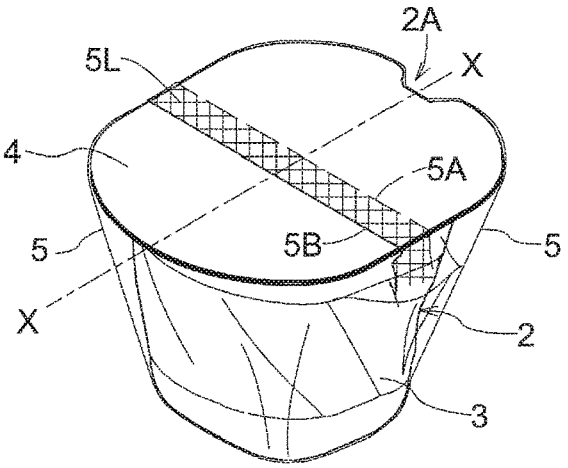
FIG. 3 is a perspective view showing an intermediate package.

FIG. 3 shows an external view of an intermediate package 1A obtained in an intermediate stage of wrapping the portion container 2, or in other words, it shows a state in which the portion container 2 has been wrapped by the heat-shrinkable resin film 5, and thus the tack label 10 has not yet been adhesively attached.

Two ends (a first edge portion 5A and a second edge portion 5B, which will be described later) of the heat-shrinkable resin film 5 form an overlapping portion 5L in which the two ends are placed one on top of the other primarily near an upper surface of the lid member 4 of the portion container 2 by a method such as electrostatic sealing, so as to form a cylindrical shape that wraps the entirety of the portion container 2.

Figure 4:
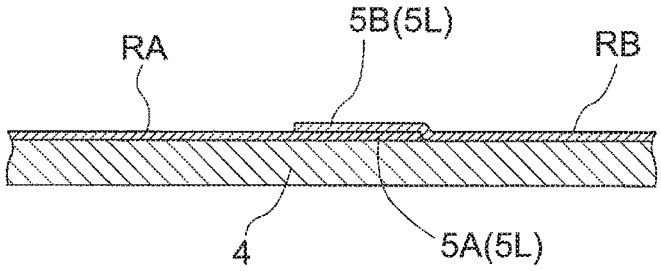
FIG. 4 is an enlarged cross-sectional view showing an overlapping portion of a protective film.

As shown in FIG. 3, the overlapping portion 5L extends along a width direction that intersects with the lengthwise direction. Also, as shown in FIG. 4, in the first edge portion 5A and the second edge portion 5B forming the overlapping portion 5L of the heat-shrinkable resin film 5, an end face of the first edge portion 5A located below (or in other words, directly opposing the lid member 4 of the portion container 2) faces toward the front end side of the package 1, and an end face of the second edge portion 5B located above (or in other words, opposing the lid member 4 via the first edge portion 5A) faces toward the rear end side of the package 1.

To rephrase it, the front end side of the portion container 2 is wrapped by a second region RB that is continuously connected to the second edge portion 5B of the heat-shrinkable resin film 5, and the rear end side of the portion container 2 is wrapped by a first region RA that is continuously connected to the first edge portion 5A of the heat-shrinkable resin film 5.

Wrapped Configuration Using Tack Label

Figure 5:
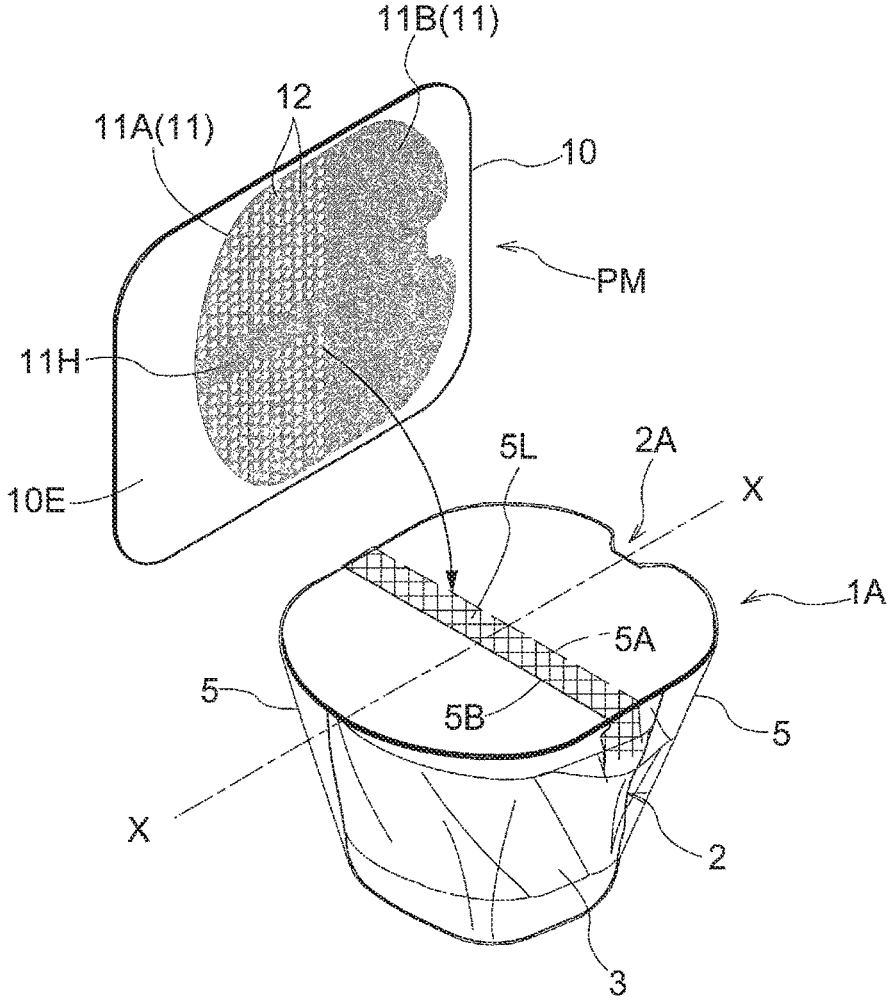
FIG. 5 is a perspective view showing a step of coupling a tack label to the intermediate package.

As shown in FIG. 5, the tack label 10 is adhesively attached to the heat-shrinkable resin film 5 of the intermediate package 1A by a planar adhesive portion 11 provided on the underside of the tack label 10 so as to cover the most part of the overlapping portion 5L, and the adhesive portion 11 includes a peeling control mechanism PM that causes the second edge portion 5B to be peeled from the first edge portion 5A in a relatively initial stage of an operation of removing the tack label 10 from the package 1.

Figure 6:
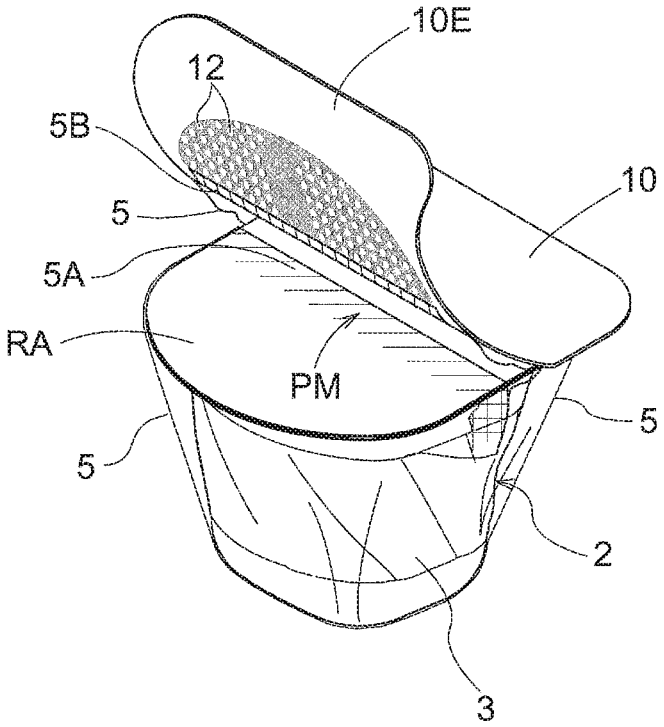
FIG. 6 is a perspective view showing a step of removing the tack label.

As a result, as shown in FIG. 6, by continuing the operation of removing the tack label 10 from the package 1, the heat-shrinkable resin film 5 is removed integrally with the tack label 10 such that the second edge portion 5B and the second region RB that is continuous with the second edge portion 5B are removed prior to the first edge portion 5A and the first region RA, and finally the first edge portion 5A and the first region RA are removed, as a result of which the heat-shrinkable resin film 5 is smoothly and reliably removed from the portion container 2.

As a specific method for implementing the peeling control mechanism PM, the adhesive portion 11 is configured to have a non-uniform coupling force distribution in which the coupling force between the second region RB continuously connected to the second edge portion 5B and the tack label 10 is higher than the coupling force between the first region RA continuously connected to the first edge portion 5A and the tack label 10.

To be more specific, as shown in FIG. 5, the adhesive portion 11 is divided into a first adhesive portion 11A adhesively attached to the first region RA which is on the rear end side and a second adhesive portion 11B adhesively attached to the second region RB which is on the front end side in the heat-shrinkable resin film 5 provided on the lid member 4. An ordinary adhesive layer is provided entirely over the second adhesive portion 11B, and a glue killing surface 12 in which the adhesive force is proactively weakened is provided over a wide area of the first adhesive portion 11A excluding an auxiliary adhesive portion 11H extending in the shape of a narrow strip along the axis X.

The glue killing surface 12 may be formed by any of the methods such as bonding a kill film, printing an adhesive force suppression ink, applying no glue as long as it is possible to obtain the effect of nullifying or reducing by half the adhesive force applied to the heat-shrinkable resin film 5.

Extension Portion of Tack Label

An extension portion 10E extending radially outwardly from the lid member 4 of the portion container 2 so as to be long is provided at an end portion of the tack label 10 along the axis X on the first region RA side, but such an extension portion is not provided on the second region side.

Accordingly, a user who attempts to unwrap the package 1 so as to take out the portion container 2 therefrom is naturally prompted to perform an operation of pinching the extension portion 10E of the tack label 10 and removing the tack label 10 from the portion container 2 at the time of removing the tack label 10 from the package 1, and thus as shown in FIG. 6, the rear end side of the tack label 10 is separated from the portion container 2 prior to the front end side of the same.

In the first half of the separation process, by the action of the glue killing surface 12 provided in the first adhesive portion 11A, the tack label 10 is separated from the heat-shrinkable resin film 5 wrapping the portion container 2 without entraining the heat-shrinkable resin film 5.

On the other hand, in the latter half of the separation process, because the second adhesive portion 11B to which an ordinary adhesive layer is entirely provided is strongly coupled to the second edge portion 5B and the second region RB of the heat-shrinkable resin film 5, the tack label 10 is removed such that, at the overlapping portion 5L of the heat-shrinkable resin film 5, the second edge portion 5B is first peeled from the first edge portion 5A, and then the second region RB is separated from the lid member 4 of the portion container 2. During separation of the second region RB, a breakage occurs between an area of the heat-shrinkable resin film 5 covering near the lid member 4 and an area of the heat-shrinkable resin film 5 covering near the container body 3 of the portion container 2, and thus the entire removal of the heat-shrinkable resin film 5 smoothly takes place. As described above, the extension portion 10E of the tack label 10 constitutes a part of the peeling control mechanism PM.

Configuration of Packaging Apparatus

Figure 7:
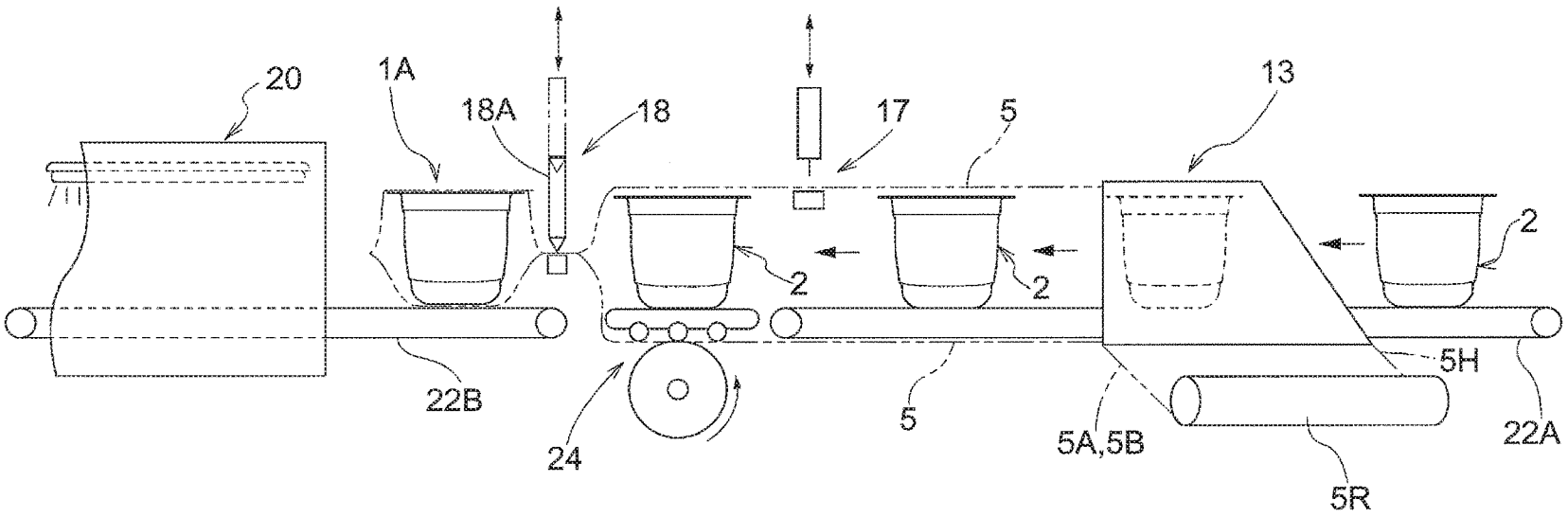
FIG. 7 is a side view showing a schematic configuration of a packaging apparatus that produces the intermediate package.

FIG. 7 shows an example of an apparatus for producing the intermediate package 1A by wrapping the portion container 2 with the heat-shrinkable resin film 5. A packaging apparatus 40 includes a forming portion 13 that forms the heat-shrinkable resin film 5 into a cylindrical shape by turning upside down the heat-shrinkable resin film 5 unwound from a roll body 5R of the heat-shrinkable resin film 5, a charging portion 17 (electrostatic sealing means) that electrostatically charges the heat-shrinkable resin film 5 that has been formed into a cylindrical shape, a thermally cutting/joining portion 18 that simultaneously performs thermal cutting and joining of the heat-shrinkable resin film 5 enclosing the portion container 2 at a position behind the portion container 2, and a shrink tunnel 20 that heat shrinks the heat-shrinkable resin film 5 enclosing the portion container 2. The portion container 2, with its rear end side facing the near side in FIG. 7, is conveyed by conveyance belts 22A and 22B disposed along the equipment.

The roll body 5R is a roll body formed by winding the heat-shrinkable resin film 5 folded in two folds, and is disposed such that a ridge line 5H between the two folds is located upstream in the conveyance direction of the portion container 2 and two opposing edge portions 5A and 5B are located downstream in the conveyance direction of the same.

In the forming portion 13, the heat-shrinkable resin film 5 with the two edge portions 5A and 5B circumferentially overlapping with each other in an upper portion of the cylinder is obtained, and as a result of the edge portions 5A and 5B closely attaching to each other by the action of electrostatic charges applied by the charging portion 17, the overlapping portion 5L extending in the conveyance direction of the portion container 2 is formed.

In the thermally cutting/joining portion 18, at a position behind the portion container 2, the heat-shrinkable resin film 5 is thermally cut and joined by a heating rod 18A, as a result of which individual portion containers 2, each wrapped by the heat-shrinkable resin film 5, are obtained.

On the upstream side of the thermally cutting/joining portion 18, a film dispensing roller pair 24 for dispensing the heat-shrinkable resin film 5 toward the downstream side is disposed at a position below the portion container 2.

An individual portion container 2 that has been wrapped by the heat-shrinkable resin film 5 is conveyed to the shrink tunnel 20, where the heat-shrinkable resin film 5 is heat shrunk, and thereby an intermediate package 1A in which the heat-shrinkable resin film 5 is closely attached to the bottom portion of the portion container 2 and the lid member 4.

Figure 8:
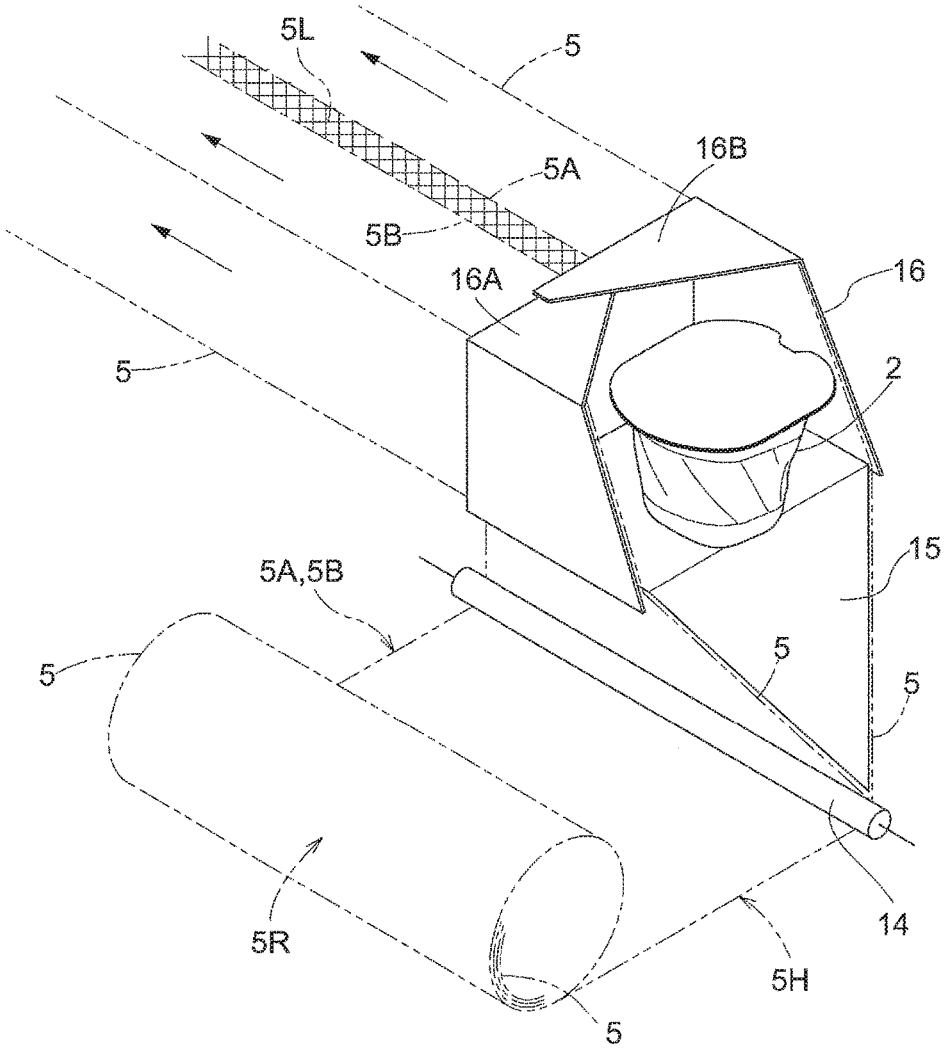
FIG. 8 is a perspective view showing a schematic configuration of a forming portion of the packaging apparatus.

As illustrated in FIG. 8 as an example, the forming portion 13 includes a turning roller 14 that changes the conveyance direction of the heat-shrinkable resin film 5, a first film guide 15 that unfolds the heat-shrinkable resin film 5, folded as if it is a single film, into a V shape while turning upside down the heat-shrinkable resin film 5, and a second film guide 16 that forms the unfolded heat-shrinkable resin film 5 into a cylindrical shape.

The second film guide 16 includes a pair of triangular edge guide portions 16A and 16B that guide the edge portions 5A and 5B of the heat-shrinkable resin film 5. A tip end of the edge guide portion 16B located on the front end side of the portion container 2 to be processed overlaps a tip end of the edge guide portion 16A located on the rear end side of the portion container 2, and thus as shown in FIG. 4, the first edge portion 5A corresponding to the first region RA that wraps the rear end side of the portion container 2 is disposed below and the second edge portion 5B corresponding to the second region RB that wraps the front end side of the portion container 2 is disposed above.

Figure 9:
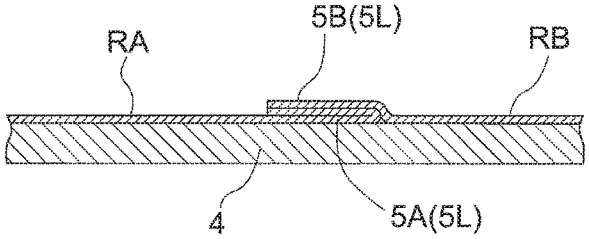
FIG. 9 is an enlarged cross-sectional view showing an overlapping portion of a protective film according to another embodiment.

Other Embodiments (1) As illustrated in FIG. 9 as an example, the overlapping portion 5L of the heat-shrinkable resin film 5 may be configured such that the first edge portion 5A that is continuous from the first region RA is folded toward the rear end side of the portion container 2, and the second edge portion 5B is disposed on the upper surface of the folded first edge portion 5A so as to overlap therewith. With this configuration as well, when the tack label 10 is removed from the package 1B, by the action of the non-uniform coupling force distribution, the second edge portion 5B is first peeled from the first edge portion 5A, and thus smooth removal of the heat-shrinkable resin film 5 without causing a rupture in the heat-shrinkable resin film 5 takes place. In this embodiment, by providing the glue killing surface 12 to the overlapping portion 5L as well, and providing the second adhesive portion 11B, where an ordinary adhesive layer is entirely provided, only to the second region RB excluding the overlapping portion 5L, it is possible to easily peel the second edge portion 5B from the first edge portion 5A along with the removal of the tack label 10.

(2) The overlapping portion 5L of the heat-shrinkable resin film 5 shown in FIGS. 4 and 9 may be implemented by a method other than electrostatic sealing such as, for example, a sealing method using a heat seal or an adhesive.

Figure 10:
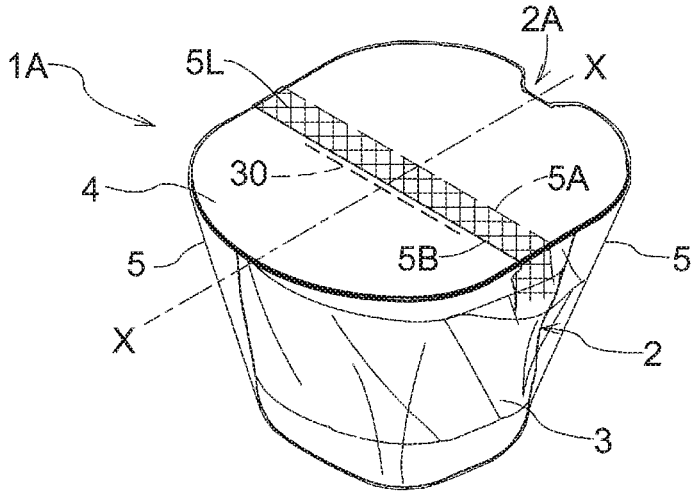
FIG. 10 is a perspective view showing another embodiment of an intermediate package.

(3) As illustrated in FIG. 10 as an example, a perforated line 30 extending along the first edge portion 5A may be formed in a portion of the first region RA of the heat-shrinkable resin film 5. With this embodiment, even if the second edge portion 5B is not smoothly peeled from the first edge portion 5A along with the removal of the tack label 10 due to the binding force between the first edge portion 5A and the second edge portion 5B at the overlapping portion 5L being too strong, the heat-shrinkable resin film 5 is cut at the position of the perforated line 30, and thus the overlapping portion 5L of the heat-shrinkable resin film 5 coupled to the tack label 10 is separated together with the second region RB from the first region RA, as a result of which smooth removal of the protective film takes place. That is, the perforated line 30 functions as the peeling control mechanism PM. In FIG. 10, the perforated line 30 is formed at a position adjacent to the overlapping portion 5L on the rear end side in the first region RA. In the packaging apparatus shown in FIG. 7, by disposing a perforated line processing portion near the charging portion 17, it is possible to form the perforated line 30 at a specific area in the heat-shrinkable resin film 5 in a stage before the portion container 2 is wrapped.

(4) If the difference of the coupling forces in the non-uniform coupling force distribution is sufficiently large, the second edge portion 5B can be peeled from the first edge portion 5A by pinching, instead of the rear end side of the tack label 10, the front end side of the same and peeling the tack label 10. Accordingly, the present invention can be implemented in an embodiment in which the extension portion 10E of the tack label 10 is omitted, and an embodiment in which extension portions similar to the extension portion 10E are provided to the rear end side and the front end side of the tack label 10.

(5) The present invention is not limited to a package in which a container is wrapped with a protective film, and is applicable to a package in which an article such as a food or any other article is directly wrapped with a protective film without housing the article in a container.

INDUSTRIAL APPLICABILITY

The present invention is an invention that can be used as a technique for solving the problems encountered with a package according to conventional technology including a protective film enclosing an article and a tack label coupled to an outer surface of the protective film.

DESCRIPTION OF REFERENCE SIGNS

1A: intermediate package
1B: package
2: portion container (article)
5: heat-shrinkable resin film (protective film)
5A: first edge portion
5B: second edge portion
5L: overlapping portion
10: tack label
10E: extension portion
11: adhesive portion (peeling control mechanism)
11A: first adhesive portion (peeling control mechanism)
11B: second adhesive portion (peeling control mechanism)
12: glue killing surface (peeling control mechanism)
17: charging portion (electrostatic sealing means)
30: perforated line (peeling control mechanism)
40: packaging apparatus
PM: peeling control mechanism
RA: first region
RB: second region
X: axis

The invention claimed is:

1. A package comprising a protective film enclosing an article and a tack label coupled to an outer surface of the protective film, wherein the protective film includes an overlapping portion in which a first edge portion directly opposing the article and a second edge portion opposing the article via the first edge portion are overlapped with each other, the tack label is coupled so as to cover the overlapping portion, a coupling surface between the protective film and the tack label is divided into a first region continuously connected to the first edge portion and a second region continuously connected to the second edge portion, a non-uniform coupling force distribution in which the second region has a higher coupling force than the first region is provided on the coupling surface, and an auxiliary adhesive portion having a higher coupling force than the first region is provided extending in the shape of a strip between two portions of the first region.

2. The package according to claim 1, wherein an extension portion extending radially outwardly from the edge of the article is provided on the first region side of the tack label such that the tack label is longer on the first region than on the second region side.

3. The package according to claim 1, wherein the second edge portion is coupled to the first edge portion by electrostatic sealing.

4. The package according to claim 1, wherein a perforated line extending along the first edge portion is provided in the first region of the protective film.

* * * * *